US008371371B2

(12) United States Patent
Diehl et al.

(10) Patent No.: US 8,371,371 B2
(45) Date of Patent: Feb. 12, 2013

(54) APPARATUS FOR IN-SITU EXTRACTION OF BITUMEN OR VERY HEAVY OIL

(75) Inventors: Dirk Diehl, Erlangen (DE); Norbert Huber, Erlangen (DE); Bernd Wacker, Herzogenaurach (DE); Jan Weigel, Groβenbuch (DE)

(73) Assignee: Siemens Aktiengesellschaft, München (DE)

( * ) Notice: Subject to any disclaimer, the term of this patent is extended or adjusted under 35 U.S.C. 154(b) by 375 days.

(21) Appl. No.: 12/674,691

(22) PCT Filed: Aug. 21, 2008

(86) PCT No.: PCT/EP2008/060927

§ 371 (c)(1),
(2), (4) Date: Feb. 23, 2010

(87) PCT Pub. No.: WO2009/027305

PCT Pub. Date: Mar. 5, 2009

(65) Prior Publication Data

US 2011/0042063 A1 Feb. 24, 2011

(30) Foreign Application Priority Data

Aug. 27, 2007 (DE) ..... 10 2007 040 605
May 5, 2008 (DE) ..... 10 2008 022 176

(51) Int. Cl.
*E21B 36/00* (2006.01)
*E21B 43/24* (2006.01)

(52) U.S. Cl. ..... 166/60; 166/245; 166/272.1

(58) Field of Classification Search ..... 166/272.7, 166/272.2, 248, 60, 272.1
See application file for complete search history.

(56) References Cited

U.S. PATENT DOCUMENTS

| | | | | |
|---|---|---|---|---|
| 4,116,273 | A * | 9/1978 | Fisher et al. | 166/248 |
| 4,144,935 | A * | 3/1979 | Bridges et al. | 166/248 |
| RE30,738 | E * | 9/1981 | Bridges et al. | 166/248 |
| 4,359,091 | A * | 11/1982 | Fisher et al. | 166/248 |
| 4,373,581 | A | 2/1983 | Toellner | |
| 4,470,459 | A * | 9/1984 | Copland | 166/248 |
| 4,645,004 | A | 2/1987 | Bridges et al. | |
| 5,449,251 | A | 9/1995 | Daily et al. | |
| 5,898,579 | A | 4/1999 | Boys et al. | |
| 6,631,761 | B2 * | 10/2003 | Yuan et al. | 166/248 |
| 2006/0151166 | A1 | 7/2006 | Montgomery et al. | |
| 2007/0144732 | A1 * | 6/2007 | Kim et al. | 166/145 |
| 2008/0073079 | A1 * | 3/2008 | Tranquilla et al. | 166/270.1 |

FOREIGN PATENT DOCUMENTS

| | | | |
|---|---|---|---|
| DE | 10 2004 009 896 | A1 | 9/2005 |
| DE | 102007008292 | A1 | 8/2008 |
| DE | 102007036832 | | 2/2009 |

* cited by examiner

*Primary Examiner* — Brad Harcourt
*Assistant Examiner* — Michael Wills, III

(57) ABSTRACT

An apparatus for the in situ extraction of bitumen or very heavy oil from oil sand deposits, and applying heat energy to the deposit to reduce the viscosity of the bitumen is provided. A high-frequency generator feeds electric power to a linearly extended conductor loop at a predefined depth of an oil sand deposit, the inductance of the conductor loop is compensated in some sections or continuously. Advantageously, one of the conductors of the conductor loop may be disposed substantially in a vertical direction above the extraction pipe.

18 Claims, 7 Drawing Sheets

APPARATUS FOR IN-SITU EXTRACTION OF BITUMEN OR VERY HEAVY OIL

CROSS REFERENCE TO RELATED APPLICATIONS

This application is the US National Stage of International Application No. PCT/EP2008/060927, filed Aug. 21, 2008 and claims the benefit thereof. The International Application claims the benefits of German application No. 10 2007 040 605.5 DE filed Aug. 27, 2007. All of the applications are incorporated by reference herein in their entirety.

FIELD OF INVENTION

The invention relates to an apparatus for "in-situ" extraction of bitumen or very heavy oil from oil sands deposits as reservoir, with heat energy being applied to the reservoir to lower the viscosity of the bitumen or very heavy oil present in the oil sand, for which purpose an electric/electromagnetic heater is provided.

BACKGROUND OF INVENTION

Oil sands deposits close to the surface can be extracted in an open-cast system if necessary, with processing to separate the oil subsequently being required. However "in-situ" methods are also known in which, by introducing "solvent" or thinning agents and/or alternatively by heating up or melting the very heavy oil the deposit is made flowable while still in the reservoir. The "in-situ" methods are especially suitable for reservoirs which are not close to the surface.

The most widespread and widely-used "in-situ" method for extracting bitumen is the SAGD (Steam Assisted Gravity Drainage) method. In this method, steam, which can be added to the solvent, is injected at high pressure through a pipe running horizontally within the reservoir. The bitumen heated-up, melted or dissolved from the sand or rock seeps down to a second pipe located around 5 m (distance between injector and production pipe depends on reservoir geometry) through which the liquefied bitumen is extracted. In this method the steam has a number of tasks to perform, namely the introduction of heat energy for liquefaction, the removal of sand and building up the pressure in the reservoir, in order on the one hand to make the reservoir porous for the transport of bitumen (permeability) and on the other hand to make it possible to extract the bitumen without additional pumps.

The SAGD method starts by both pipes being heated up by steam, typically for 3 months, in order to initially liquefy the bitumen in the space between the pipes as quickly as possible. Then steam is introduced into the reservoir through the upper pipe and extraction through the lower pipe can begin.

A method for resistive heating up of a very heavy oil deposit is known from US 2006/0151166 A1, in which a tool with electrodes for a three-phase resistive heating of the deposit is provided for reducing the viscosity of the very heavy oil. With the applicant's older, not previously published German patent applications AZ 10 2007 008 292.6 entitled "Vorrichtung and Verfahren zur in situ-Gewinnung einer kohlenwasserstoffhaltigen Substanz unter Herabsetzung deren Viskosität aus einer unterirdischen Lagerstätte (apparatus and method for in-situ extraction of a substance containing hydrocarbons from an underground deposit while reducing its viscosity)" and AZ 10 2007 036 832.3 entitled "Vorrichtung zur in situ-Gewinnung einer kohlenwasserstoffhaltigen Substanz (apparatus and method for in-situ extraction of a substance containing hydrocarbons)" electrical/electromagnetic heating methods for an "in situ" extraction of bitumen and/or very heavy oil have already been proposed in which in particular an inductive heating of the reservoir is undertaken.

Using the prior art as its starting point, the object of the invention is to create an apparatus with a suitable design for electrical/electromagnetic heating of the reservoir of an oil sands deposit.

SUMMARY OF INVENTION

The object is inventively achieved by the features of the claims. Developments of the invention are specified in the subclaims.

The subject matter of the invention is the application in mining of a resonantly-tuned harmonic circuit for inductive heating up of an oil sands deposit referred to as a reservoir underground at a depth of up to several hundred meters in an "in-situ" oil production process. To achieve this object the inventive apparatus contains an external alternating current generator known per se for electrical power which is used to supply power to a conductor loop. The conductor loop is formed from two or more conductors which are connected electrically-conductively inside or outside the reservoir. The inductance of the conductor loop is compensated for in sections. This avoids any undesired reactive power. The ac-supplied conductor loop creates an alternating magnetic field in the reservoir through which eddy currents are stimulated in the reservoir which lead to the heating up of same.

Two inductive effects are to be distinguished in the invention:

- The overall inductance of the conductor loop which is primarily formed by the undesired self-inductance and must be compensated for to prevent a large voltage drop along the lines and to not demand any reactive power from the generator.
- The desired mutual inductance to the reservoir, which makes possible the current flow and thereby the heating up of the reservoir.

The inventive apparatus makes it possible to heat up unconventional heavy oil with viscosities of e.g. 5° API to 15° API from temperatures of 10° C. ambient temperature to as much as 280° C. This enables the oil to flow in a gravitative process through the improvement of the fluidity down to the lower non-permeable boundary layer and to flow out from there by means of known drainage production pipes, in order to either be pumped by means of lifting pumps up to the surface or to be conveyed to the surface overcoming gravity through the pressure built up in the reservoir by heating and/or injection of steam.

In the invention the electromagnetic heating process can be combined with a steam process which is injected for an improved permeability and/or conductivity e.g. by an additional electrolytic additive. It is also possible to have the steam simulation through the production pipe undertaken at the beginning of the heating-up phase or later cyclically.

In a specific development a purely electromagnetic-inductive method for heating up and extracting bitumen can be provided with especially favorable arrangement of the inductors. The essential factor here is to place one of the inductors directly over the production pipe, i.e. without any significant horizontal offset. An offset cannot be entirely avoided when drilling the bore holes however. The offset should be less than 10 m in any event, preferably less than 5 m, which is viewed as negligible with the corresponding dimensions of the deposit.

This involves the positioning of those inductors which are decisive for an extraction method without steam, as well as the electrical connection of the conductor sections.

Where the invention refers exclusively to electromagnetic heating, this is also called the EMGD (Ëlectro-Magnetic Drainage Gravity) method. The EMGD method involves the positioning of the inductors with individual conductor sections which are very much the decisive factor for an extraction method without steam, as well as the electrical connections of the conductor sections.

BRIEF DESCRIPTION OF THE DRAWINGS

Further details and advantages of the invention emerge for the subsequent description of the figures of exemplary embodiments based on the drawing in conjunction with the patent claims.

The figures show the following schematic diagrams.

DETAILED DESCRIPTION OF INVENTION

The same units or units that act in the same way are provided in the figures with the same or corresponding reference signs. The figures are described below in groups together in each case.

Figure 1:
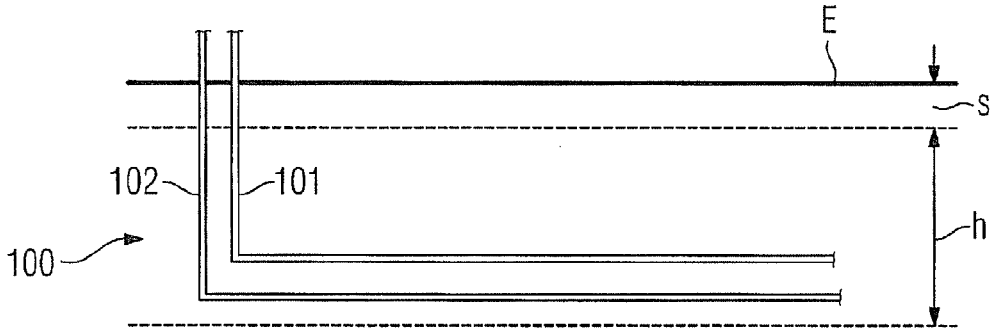
FIG 1 (Prior art)
FIG. 1 a section through an oil sands reservoir with injection and extraction pipe, FIG. 2 a perspective section from an oil sands reservoir with an electric conductor loop running horizontally in the reservoir, FIG. 3 an illustration of the electrical compensation of longitudinal conductor inductances by series capacitors, FIG. 4 a section through a conductor with tubular electrodes of the integrated capacitors, FIG. 5 a conductor with tubular electrodes of the integrated capacitors nested within one another, FIG. 6 a tubular electrode with integrated capacitors and an apparatus for introducing electrolyte, FIGS. 7*a* and 7*b* the electrical principle of the apparatuses according to FIG. 4 and FIG. 5 as a conventional coaxial arrangement, FIG. 8 a first embodiment of the circuit technology of a power generator for an inductive heating circuit which is suitable for use in FIG. 1/2, FIG. 9 a second embodiment of the circuit technology of a power generator for an inductive heating circuit with parallel connection of inverters, FIG. 10 a third embodiment of the circuit technology of a power generator for an inductive heating circuit with series connection of clocked inverters.
Figure 2:
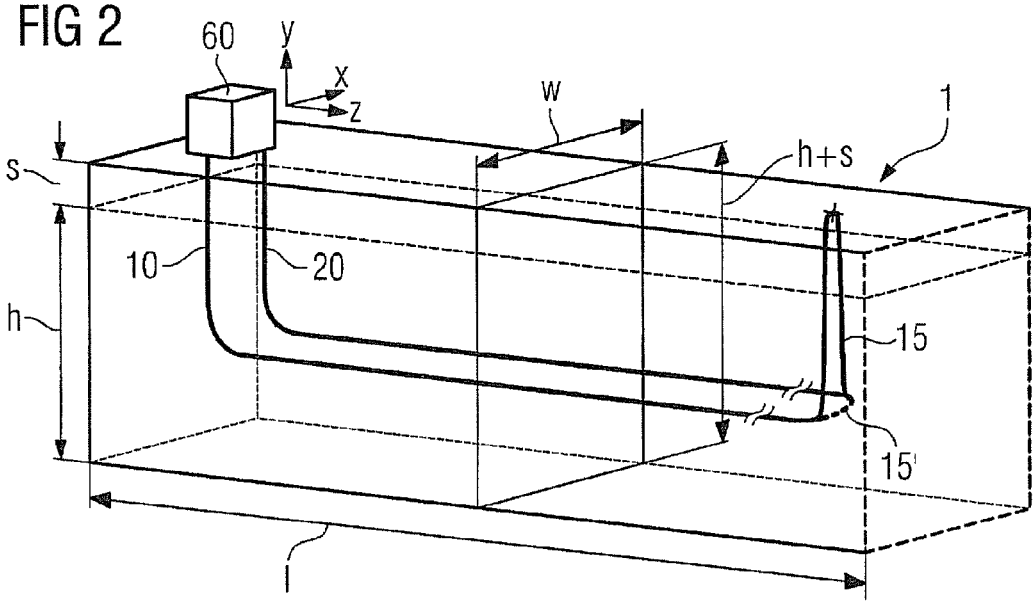

An oil sands deposit 100 referred to as a reservoir is shown in FIGS. 1 and 2, with subsequent remarks always identifying a cuboid unit 1 of length 1, width w and height h. The length 1 can amount to several multiples of 500 m, the width w to 60 m and the height h to between 20 and 100 m. It should be noted that, starting from the surface of the earth E, a "superstructure" of size s of up to 500 m can be present.

For realizing the SAGD method, according to FIG. 1 an injector pipe 101 for steam or a water/steam mixture and an extraction pipe 102 for the liquefied bitumen or oil is present in the known way in the oil sands reservoir 100 of the deposit.

FIG. 2 shows an arrangement for inductive heating. This can be formed by a long, i.e. a few hundred m to 1.5 km conductor loop 10 to 20 laid in the ground, with inductor conductors 10 and 20 being routed next to one another at a predetermined distance and being connected to each other as a conductor loop at the end via an element 15 or 15'. The element 15 is especially arranged outside the reservoir 100 and the element 15' alternately inside the reservoir. At the start the conductors 10 and 20 are routed vertically or at a shallow angle through the superstructure to the reservoir 100 and supplied with electrical power by an HF generator 60 which can be accommodated in an external housing. In particular the conductors 10 and 20 run at the same depth alongside one another, but also possibly above one another. There is a lateral offset of the conductors 10 and 20.

Typical spacings between the outward and return conductors 10, 20 are between 5 and 60 m for an external diameter of the conductors of between 10 and 50 cm (0.1 to 0.5 m).

An electrical twin conductor 10, 20 in FIG. 2 with the typical dimensions given here has a longitudinal inductance figure of 1.0 to 2.7 μH/m. The cross capacitance figure for the dimensions given is only between 10 and 100 pF/m so that the capacitive cross currents can be initially ignored. Ripple effects are to be avoided in such cases. The ripple speed is given by the capacitance and induction figure of the conductor arrangement. The characteristic frequency of the arrangement is conditional on the loop length and the ripple propagation speed along the arrangement of the twin conductor 10, 20. The loop length is thus to be selected short enough for no disruptive ripple effects to be produced here.

It can be shown that the simulated power loss density distribution in a plane at right angles to the conductors—as is embodied in an opposing-phase powering of the upper and lower conductor—reduces radially.

For an inductively-introduced heating power of 1 kW per meter of twin conductor, at 50 kHz a current amplitude of around 350 A is needed for low-resistance reservoirs with specific resistances of 30 Ω·m and around 950 A for high-resistance reservoirs with specific resistances of 500 Ω·m. The required current amplitude for 1 kW/m falls quadratically with the excitation frequency. I.e. at 100 kHz the current amplitudes fall to ¼ of the above values.

At an average current amplitude of 500 A at 50 kHz and a typical inductance figure of 2 μH/m the inductive voltage drop amounts to around 300 V/m.

With the overall lengths of the twin conductors 10, 20 given above the overall inductive voltage drop would add up to values > 100 kV. Such high voltages must be avoided for the following reasons:

- A controlling inverter is characterized by the apparent power, i.e. the blocking voltage and current carrying capacity, so that the reduction of the reactive power demand is vital.
- The electrodes would have to be insulated from the reservoir 100 to be high-voltage-proof in order to suppress a resistive current flow, which requires large insulation thicknesses and would make the electrodes and their insertion into the reservoir more expensive.
- Insulation problems or dangers of flashover, especially at the current conducting points.

Figure 3:
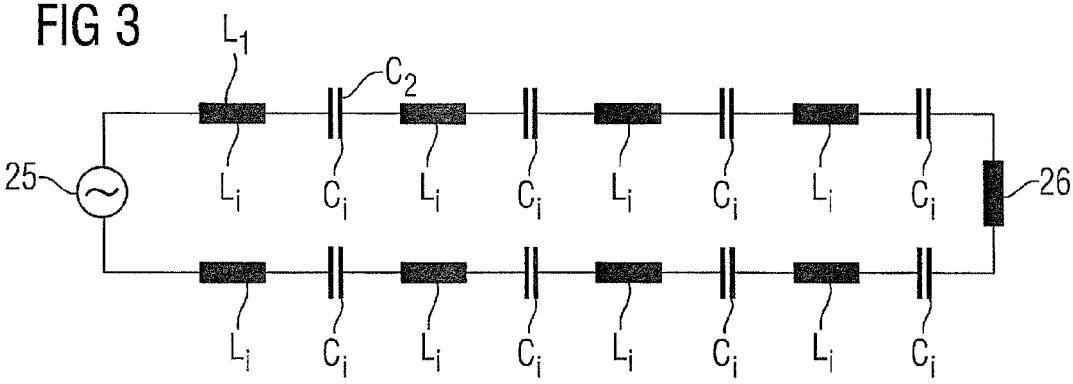

There is therefore provision to compensate for the conductor inductance L in sections by discrete or continuously embodied series capacitances C, as is shown schematically in FIG. 3. This type of compensation is actually known from the prior art in inductive energy transmission systems on translationally moved systems. In the current context this provides particular advantages.

A peculiarity of a compensation integrated into the conductor is that the frequency of the RF conductor generator must be tuned to the resonant frequency of the current loop. This means that the twin conductor 10, 20, when used for heating purposes, i.e. with high current amplitudes, can only be operated at this frequency.

The decisive advantage in the latter mode of operation lies in the fact that an addition of the inductive voltages along the conductor is prevented. If in the example given above—i.e. 500 A, 2 μH/m, 50 kHz and 300 V/m—a capacitor $C_i$ of 1 μF capacitance is inserted every 10 m in the outwards and return conductor, the operation of this arrangement can be carried out resonantly at 50 kHz. This limits the inductive and accordingly capacitive sum voltages occurring to 3 kV.

If the distance between adjacent capacitors $C_i$ is reduced the capacitance values must conversely increase in proportion to the distance—with a reduced requirement for the dielectric strength of the capacitors in proportion to the distance in order to retain the same resonant frequency.

Figure 4:
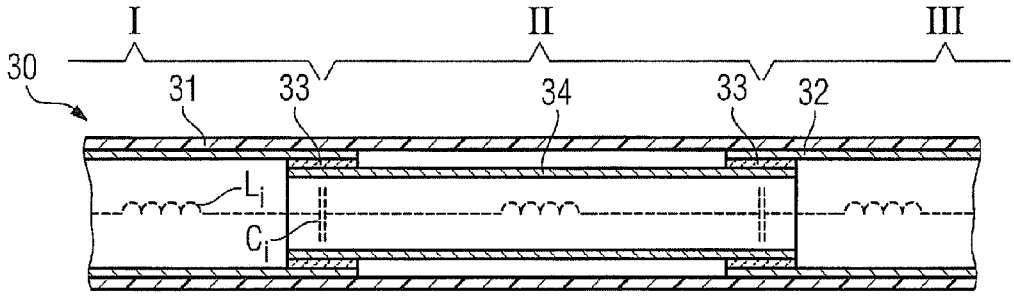

FIG. 4 shows an advantageous embodiment of capacitors integrated into the conductor with respective capacitance C where the conductor includes an insulating tube 30, a tubular outer electrode 32, and a tubular inner electrode 34. The capacitance is fanned by cylinder capacitors $C_i$ between a tubular outer electrode 32 of a section I and a tubular inner electrode 34 of the section II, between which a dielectric 33 is located. The adjacent capacitor between the sections II and III is formed in an entirely corresponding way.

For the dielectric of the capacitor C, as well as a high dielectric strength, a high temperature resistance is also a requirement, since the conductor is located in the inductively-heated reservoir 100, which can reach a temperature of 250° C. for example, and the resistive losses in the conductors 10-20 can lead to a further heating up of the electrodes. The requirements imposed on the dielectric 33 are fulfilled by a plurality of capacitor ceramics. The dielectric 33 may also be formed from composites based on Teflon, glass fiber, and ceramic.

For example the group of aluminum silicate, i.e. porcelains, exhibit temperature resistances of several 100° C. and electrical flashover resistances of >20 kV/mm with permittivity figures of 6. This means that the above cylinder capacitors can be realized with the required capacitance and can typically be between 1 and 2 m in length.

Figure 5:
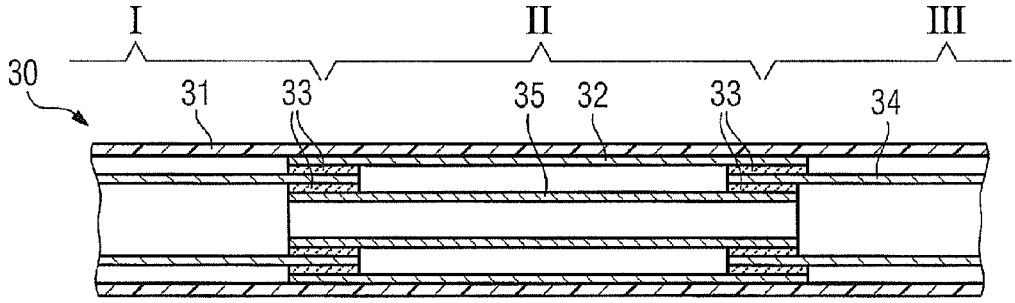
Figure 7A:
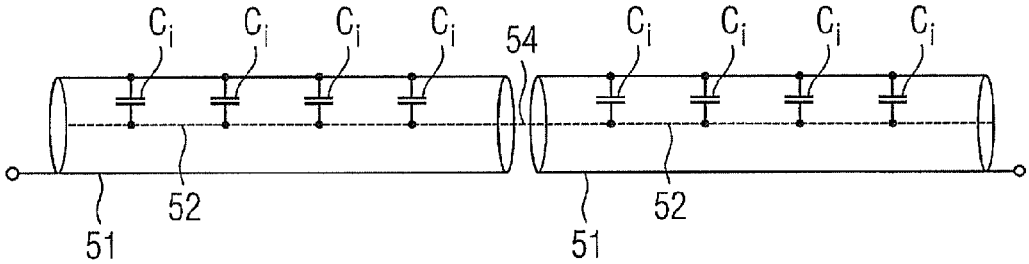
Figure 7B:
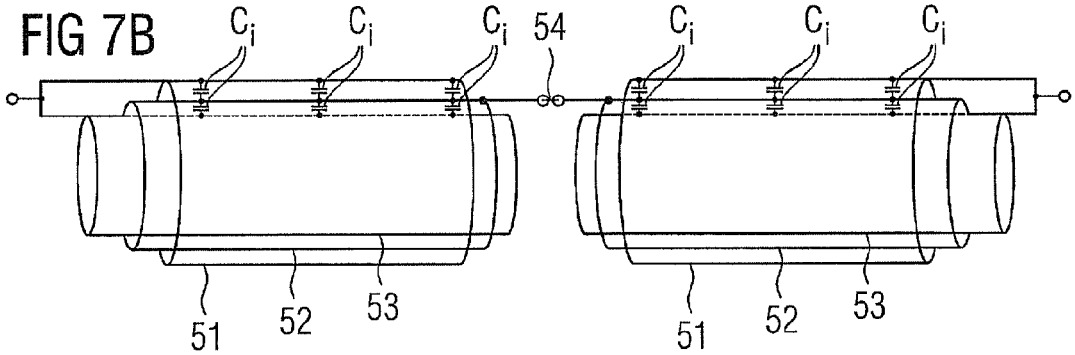

If the length is to be shorter, a nesting of the number of coaxial electrode in accordance with the principle illustrated in FIGS. 5 and 7*b* is to be provided. Other normal capacitor designs can also be integrated into the conductor provided these the exhibit the required voltage and temperature resistance.

In FIG. 4 the entire electrode is already surrounded by an insulation layer 31. The insulation from the surrounding earth is necessary to prevent resistive currents through the earth between the adjacent sections, especially in the area of the capacitors. The insulation further prevents the resistive current flow between outward and return conductor. The requirements in respect of the dielectric strength the insulation are however reduced by comparison with the non-compensated conductor of >100 kV in the above example to something over 3 kV and can therefore be met by a plurality of insulating materials. The insulation, like the dielectric of the capacitors, must have permanent resistance to higher temperatures, with ceramic insulation materials again being suitable for this purpose. In such cases the insulation thickness of the insulation layer 31 should not be selected too small since otherwise capacitive leakage currents could flow out into the surrounding earth. Insulation material thicknesses greater than 2 mm for example are sufficient in the above exemplary embodiment.

In detail FIG. 5 shows that the number of tubular electrodes are connected in parallel. Advantageously the parallel connection of the capacitors can be used to increase the capacitance or to increase its dielectric strength. The electrical principle for this is shown in FIG. 7*b*.

Figure 6:
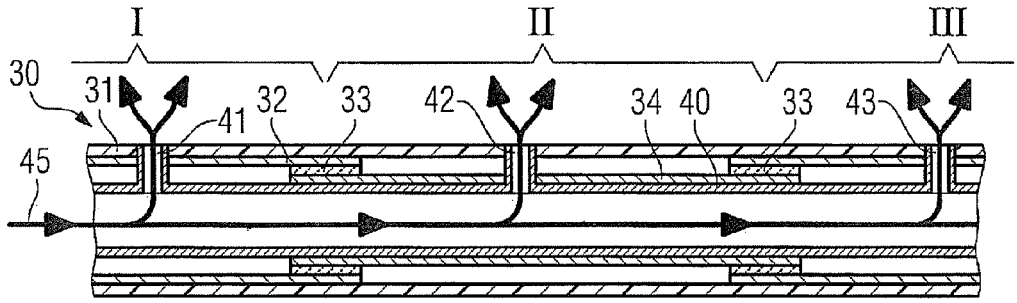

In an arrangement in accordance with FIG. 4 an introduction of an electrolyte 45 in sections can be carried out for explicitly increasing the heating effect. In FIG. 6 the compensated electrode is expanded by an insulated inner pipe 40 with insulated outlet openings 41, 42 and 43. This enables water or an electrically-conductive aqueous salt solution or another electrolyte to be introduced into the reservoir for example in order to increase the conductivity of the reservoir.

The introduced water can also serve to cool the conductor. If the outlet openings are replaced by valves the change in conductivity can be explicitly undertaken temporally and spatially in sections.

The increase in the conductivity is used to increase the inductive heating effect without having to increase the current amplitude in the conductors.

In FIGS. 4 and 5 the longitudinal inductances are therefore compensated for by means of primarily concentrated cross capacitances. Instead of introducing more or fewer short capacitors as concentrated elements into the conductor, the capacitance figure that a two-wire conductor such as a coaxial conductor or multiwire conductors for example provided in any event over their entire length can be used to compensate for the longitudinal inductances. To this end the inner and outer conductor are interrupted alternately at equal distances and thereby the current flow forced over the distributed cross capacitances. Such a method is described in DE 10 2004 009 896 A1. In this document belonging to the prior art it is explained in detail how the resonant frequency can be adjusted by the distances between the conductor interruptions.

The latter concepts, which are illustrated with reference to FIG. 7*a* and FIG. 7*b*, can also be used to advantage here for the conductors for inductive reservoir heating, if the conductors—as already described above—are provided with an additional outer insulation in order to suppress resistive cross currents into the surrounding earth. In detail the numbers 51 to 53 in these figures indicate the electrodes, $C_i$ indicates the capacitances distributed via the electrodes and 54 indicates a respective interruption of the conductor. The advantage of the distributed capacitances lies in a reduced requirement for dielectric strength of the dielectric.

Naturally a compensated electrode with distributed capacitances in combination with an apparatus for introducing electrolyte can also be used.

A heating effect is not desirable in the superstructure through which the outward and return conductor to reservoir 100 are routed vertically. In the vertical area of the twin conductors 10, 20 which does not yet lie in the reservoir 100, but leads down to the latter, outwards conductor 10 and return conductor 20 can be placed at a small distance of for example 1 to 3 m away from each other, whereby their magnetic fields already compensate for each other in the smaller distance from the twin conductor and the inductive heating effect is correspondingly reduced.

As an alternative outwards conductor 10 and return conductor 20 can be surrounded by a screening made of highly-conductive material surrounding one of the two conductors in order to avoid the inductive heating up of the surrounding earth of the superstructure.

In a further alternative a coaxial conductor arrangement in the vertical area of outwards and return conductor is conceivable which leads to a complete extinction of the magnetic fields in the outer area and thereby to no inductive heating up of the surrounding earth. The increased cross capacitance figure in this case can be employed to assist the embodiment of the gyrator which in accordance with the prior art converts a voltage of a voltage-injecting current converter into an alternating current.

In all three of the given methods a compensation of the respective inductance figure of the conductor arrangement including the screening which may be present is necessary.

Figure 8:
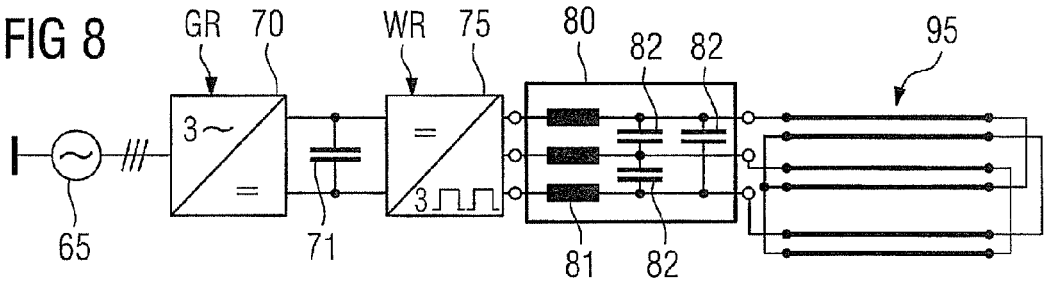

A power generator 60 which is embodied as a high-frequency generator is shown in FIG. 8. The power generator 60 is a three-phase design and advantageously contains a transformational coupling and power semiconductor as its components. The actual compensated conductor loop 10, 20 is shown in this diagram abstracted as an inductor 95. In particular the circuit contains a voltage-injecting converter. A current injection with load-independent fundamental mode which is able to be set by means of filter components, with a suitable choice of adaptation quadripole is produced beyond the latter. Depending on the topology of the quadripole, a different current loading of the feeding converter is produced.

The high-frequency generator 60 embodied as a power generator in accordance with FIG. 7 can generate outputs of up to 2500 kW. Typically frequencies of between 5 and 20 kHz are used.

If necessary higher frequencies can also be employed. In such cases increased switching losses which are sometimes too high occur in the feeding current converter. To remedy this:

- A number of inverters can be connected in parallel either at resonant frequency and small individual power and high overall power. For example the reader is referred to the topology from FIG. 9, in which the voltage-injecting full bridge, four-quadrant setter feed a parallel-switching filter which converts the square wave output voltage into an output current and of which the fundamental mode amplitude is independent of the load impedance.
- Accordingly a number of inverters can be connected in series as in FIG. 10.
- Alternately a number of inverters can also in the same topology as in FIG. 10 can be operated with offset clocks at low individual frequency to obtain a high-frequency (resonant frequency fr) at the transformer output.

As already explained, with such a generator, operation under resonant conditions is required for use according to specifications in order to achieve a reactive power compensation. If necessary the activation frequency in operation is to be suitably adjusted.

FIG. 8 illustrates the function of the RF generator already mentioned in conjunction with FIG. 2: Starting from the three-phase AC mains source 65, a three-phase inverter 70 is activated, downstream from which is connected via a conductor with capacitor 71 a three-phase inverter 75 that generates periodic square-wave signals of suitable frequency. Inductors 95 are controlled as an output via an adaptation network 80 consisting of inductances 81 and capacitors 82. It is possible to dispense with the adaptation network.

With a pure conductor loop 10, 15, 20 according to FIG. 2, which represents a two-pole inductor, a single-phase generator can also be used. Such generators, with 440 KW at 50 Hz, are commercially available.

Figure 9:
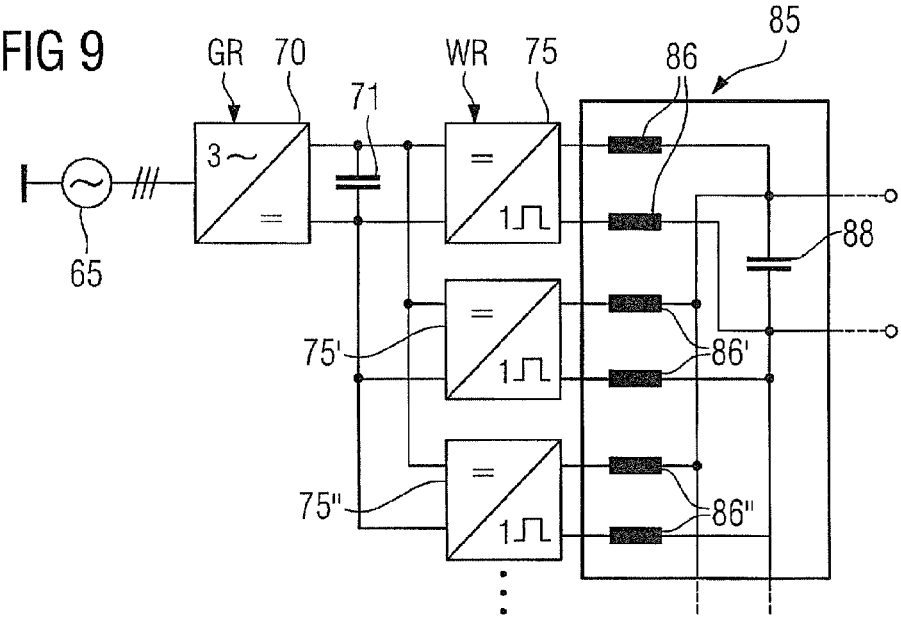

Shown in FIG. 9 is a corresponding circuit with three parallel-switched inverters 75. 75', 75". Connected downstream here is an example of an adaptation network 85 comprising inductances 86, 86' and 86". The adaptation network 85 is followed, as in FIG. 8, by the inductors not shown in any greater detail here.

Figure 10:
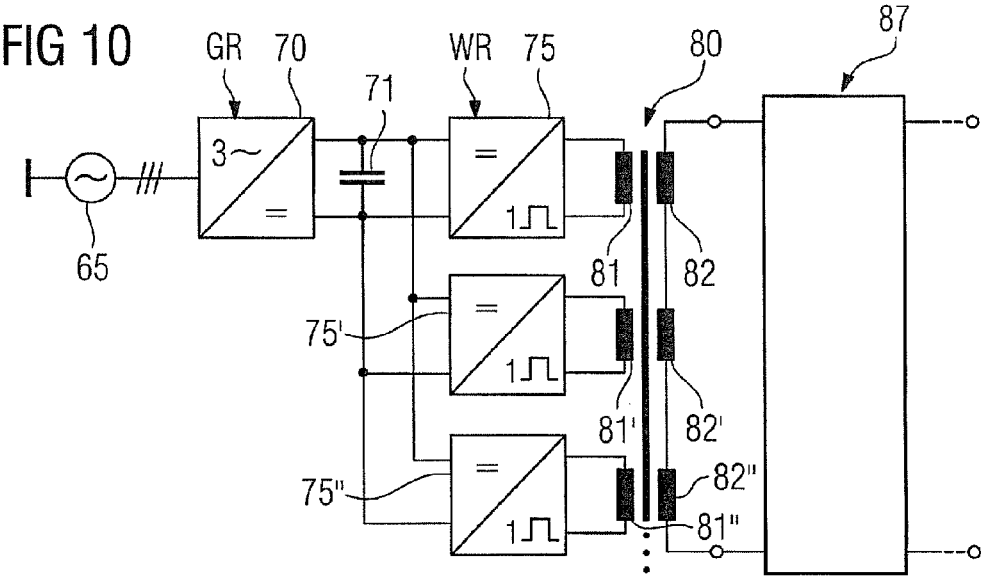

Finally the function of a series circuit of three inverters 75, 75', 75" is realized in FIG. 10, in which higher frequencies and powers, are achieved by offset clocking or higher voltages and thereby powers are achieved with in-phase clocking. For this the switched inverters 75, 75', 75" are connected by means of a transformer 80 to inductances 81, 81', 81" on the primary side as well as inductances 82, 82', 82" on the secondary side, so that a series circuit is produced on the secondary side. An adaptation quadripole of the inductors can again be connected upstream of the transformer.

The described RF generators can basically be used as described as voltage-injecting converters or accordingly as current-injecting converters in reservoirs, with or without there being support by steam. Reservoirs with lower horizontal permeability, which are insufficiently permeable to steam, can be heated up over wide areas with this method. Even if the electrical conductivity of the reservoir exhibits inhomogeneities—for example conductive areas that are insulated electrically from the rest of the reservoir, eddy currents can form in these islands and create Joulean heat. It is not effectively possible here to use vertical electrodes with resistive heating, since this requires contiguous electrically-conductive areas between the electrodes. In addition the conductance of the reservoir and permeability are related.

Figure 11:
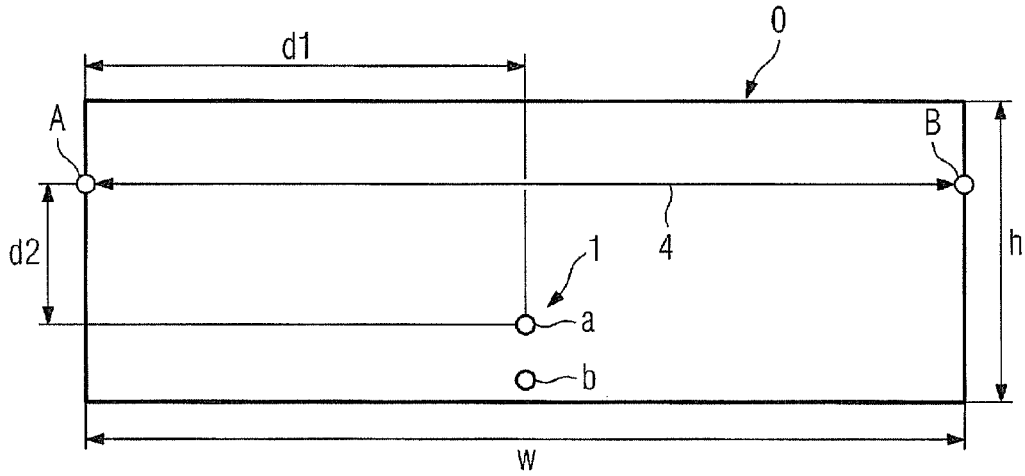
FIG. 11 by combination of FIG. 1 and FIG. 2, the prior art of the SAGD method with electromagnetic-inductive support, FIG. 12 the electrical connection of the inductive conductor sections with two conductor sections, FIG. 13 the electrical connection of the inductive conductor sections with three conductor sections with parallel connection of two conductor sections FIG. 14 the electrical connection of the inductive conductor sections with three conductor sections with alternating current and FIGS. 15 to 16 four variants of the new EMGD method with different arrangement of the inductors.

In FIG. 11, which basically shows a combination of FIGS. 1 and 2 in a projection view, the following labels are used.

0: Section of oil reservoir, is repeated multiply on both sides
1': Horizontal well pair, with injection pipe a and production pipe b, shown in cross section
A: 1st horizontal, parallel inductor
B: 2nd horizontal, parallel inductor
4: Inductive power supply by electrical connection to the ends of the inductors (according to FIG. 12)
w: Reservoir width, distance from one well pair to the next (typically 50 to 200 m)
h: Reservoir height, thickness of the geological oil layer (typically 20 to 60 m)
d1: horizontal distance from A to 1 is w/2
d2: vertical distance from A and B to a: 0.1 m to 0.9*h (typically 20 m to 60 m)

Arranging a conductor section or the conductor loop directly above the production pipe gives the specific advantage that the bitumen in the environment above the production pipe is heated up in a comparatively short time and thereby becomes thin. The effect of this is that production begins after a comparatively short time (e.g. 6 months) which is accompanied by a relieving of the pressure of the reservoir. Typically the pressure of a reservoir is limited and dependent on the strength of the superstructure in order to prevent the vaporized water from breaking through (e.g. 12 bar at a depth of 120 m, 40 bar at a depth of 400 m, . . . ). Since the electric heating results in an increase in pressure in the reservoir, the amount of power for heating up must be controlled as a function of the pressure. This in its turn means that a higher heating power is only possible once production has started.

The early extraction is made possible by arranging the inductors close to one another. Putting two inductors that are linked into a conductor loop close to one another is not possible since then the inductive heating power would be greatly reduced and the amount of power required in the cable would become too great.

Figure 12:
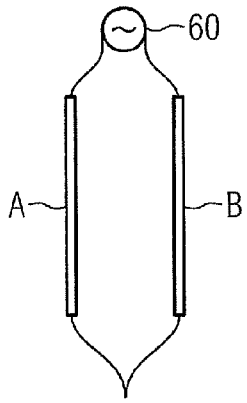
Figure 13:
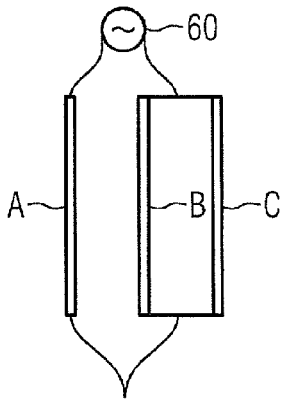
Figure 14:
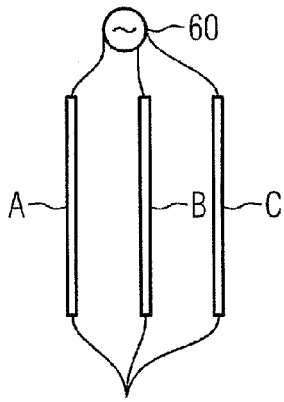

The associated electrical circuit emerges from FIGS. 12 to 14. A distinction is to be made here as to whether there are two or three conductor sections.

In FIG. 13 A is a first inductive conductor section and B is a second inductive conductor section, to which a converter/high-frequency generator 60 from FIG. 2 is connected.

FIG. 13 shows a switching variant in which three inductors are used, with two of these carrying half of the current. In FIG. 13 A is a first inductive conductor section, B is a second inductive conductor section and C is a third inductive conductor section, with conductor sections B and C being connected in parallel. Other combinations of the conductor sections are also possible. A converter/high-frequency generator is present.

FIG. 14 shows a switching variant in which three inductors are likewise used, but which are connected to an alternating current generator and therefore all have the same amount of current. In FIG. 14 A is a first inductive conductor section, B is a second inductive conductor section and C is a third inductive conductor section. All conductor sections are connected to an alternating current converter/high-frequency generator.

The switching variants according to FIGS. 12 through 14 are used to realize the arrangements of the inductors in the reservoir described below on the basis of FIGS. 15 through 18. In this case one inductor, for example inductive conductor section A or A', serves as outward conductor and one inductor B or B' as return conductor, with outward conductor and return conductor in this case carrying the same current strength with a phase offset of 180° in relation to the sectional diagrams in FIGS. 15 and 16.

As depicted in FIG. 13, one inductor A can also serve as the outward conductor and two inductors B and C as the return conductors. In this case the parallel-switched return conductors B, C each have the current strength with an offset of 180° in relation to the current of outward conductor A.

Finally one inductor can serve as an outwards conductor and more than two conductors as return conductors, with the phase offset of the currents of the outward conductor to all return conductors amounting to 180° and the sum of the return conductor currents corresponding to the outward conductor current.

In accordance with FIG. 14 three inductors A, B and C can carry the same current strength and the phase offset between said conductors can be 120°. The three inductors A, B and C are fed on the input side by the alternating current generator and are connected on the output side in a star point which can lie with or outside the reservoir and corresponds to the connection element 15. In such cases it is also possible for the three inductors A, B and C to carry unequal current strengths and to have phase offsets other than 120°. Current strengths and phase offsets are selected such that a circuit with a star point is made possible. In this case the sum of the outward currents corresponds at all times to the sum of the return currents.

Figure 15:
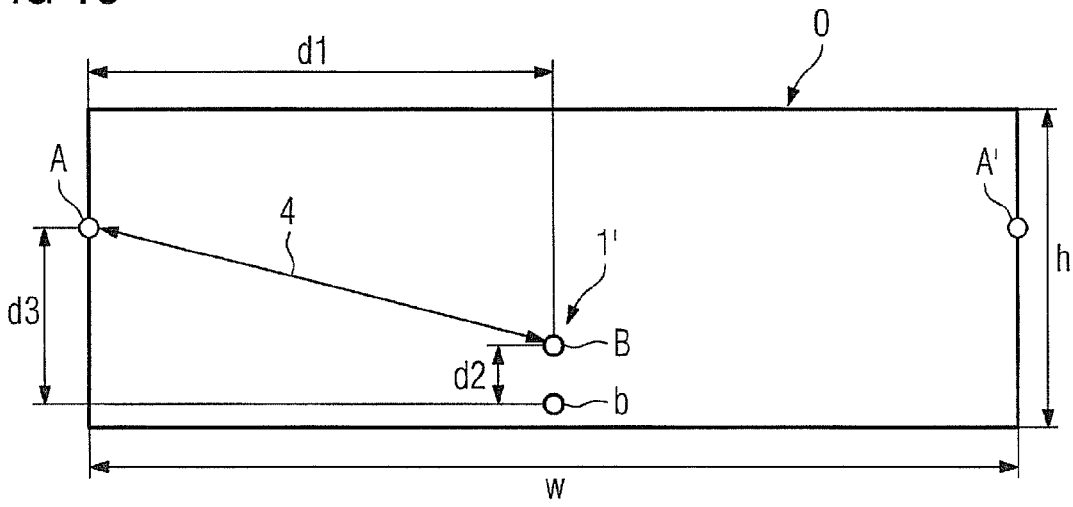
Figure 16:
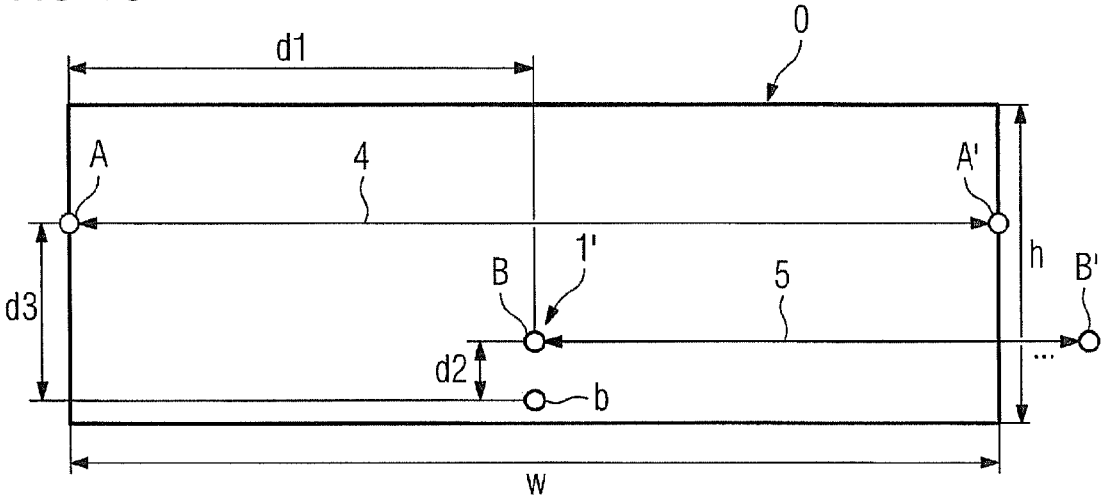

FIG. 15 shows a first advantageous embodiment for an EMGD method. One inductor is present above the production pipe and a second inductor on the line of symmetry. The labels have been selected as follows:

0: Section of oil reservoir, is repeated multiply on both sides
b: Production pipe, shown in cross section
A: 1st horizontal, parallel inductor
B: 2nd horizontal, parallel inductor
A': 1st horizontal, parallel inductor of the adjacent reservoir section
4: Inductive power supply by electrical connection to the ends of the inductors (according to FIG. 4)
w: Reservoir width, distance from one well pair to the next (typically 50 to 200 m)
h: Reservoir height, thickness of the geological oil layer (typically 20 to 60 m)
d1: horizontal distance from A to B (w/2)
d2: vertical distance from B to b: preferably 2 m to 20 m
d3: vertical distance from A to b: preferably 10 in to 20 m A further advantageous embodiment of an EMGD method is shown in FIG. 16. The figure shows a first inductor above the production pipe and a second inductor on the line of symmetry, but by contrast with FIG. 15 there are two separate circuits. The labels have been selected as follows:

0: Section of oil reservoir, is repeated multiply on both sides
b: Production pipe, shown in cross section
A: 1st horizontal, parallel inductor
B: 2nd horizontal, parallel inductor
A': 1st horizontal parallel inductor of the adjacent reservoir section
B': 2nd horizontal parallel inductor of the adjacent reservoir section
4: Inductive power supply by electrical connection to the ends of the inductors (according to FIG. 13)
w: Reservoir width, distance from one well pair to the next (typically 50 to 200 m)
h: Reservoir height, thickness of the geological oil layer (typically 20 to 60 m)
d2: horizontal distance from A to B (w/2)
d2: vertical distance from B to b: preferably 2 m to 20 m
d3: vertical distance from A to b: preferably 10 m to 20 m.

Figure 17:
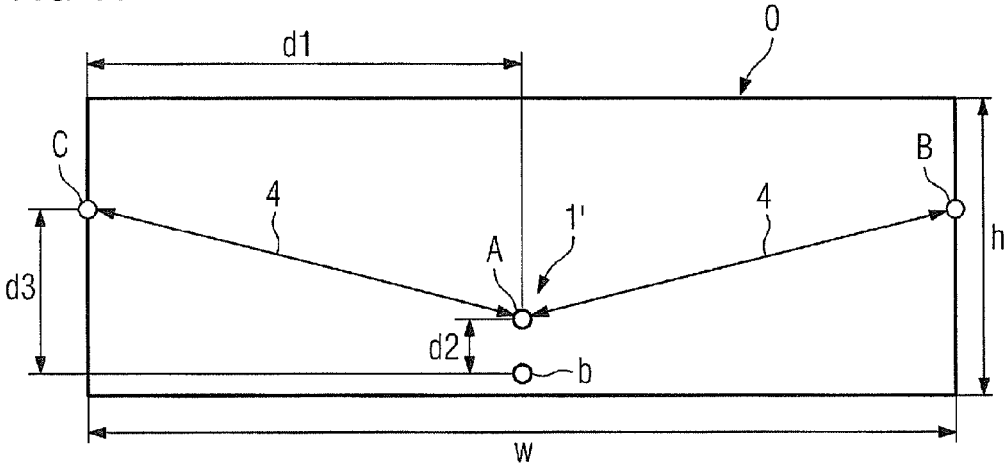

A third advantageous embodiment of an EMGD method is shown in FIG. 17. There is a first inductor above the production pipe and two inductors on the line of symmetry, with the circuit being branched. The labels have been selected as follows:

0: Production pipe, shown in cross section
A: 1st horizontal, parallel inductor directly above the production pipe b
B: 2nd horizontal, parallel inductor on the line of symmetry to the adjacent reservoir section
C: 3rd horizontal, parallel inductor on the line of symmetry to the adjacent reservoir section 4: inductive power supply by electrical connection to the ends of the inductors (in accordance with FIG. 13)
5: Second inductive power supply by electrical connection to the ends of the inductors
w: Reservoir width, distance from one well pair to the next (typically 50 to 200 m)
h: Reservoir height, thickness of the geological oil layer (typically 20 to 60 m)
d2: horizontal distance from A to B (w/2)
d2: vertical distance from B to b: preferably 2 m to 20 m
d3: vertical distance from A to b: preferably 10 m to 20 m.

Figure 18:
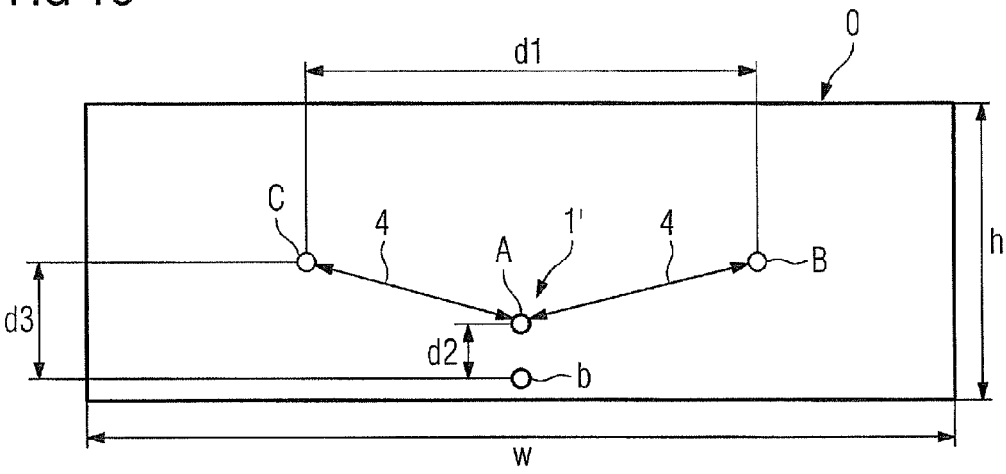

A fourth advantageous embodiment of the invention for an EMGD method is shown in FIG. 18. There is a first inductor above the production pipe and there are two further inductors with lateral offset, with a branched circuit again being present. The labels have been selected as follows:

0: Section of oil reservoir, is repeated multiply on both sides
b: Production pipe, shown in cross section
A: 1st horizontal, parallel inductor directly above the production pipe b B: 2nd horizontal, parallel inductor B: 3rd horizontal, parallel inductor 4: Inductive power supply by electrical connection to the ends of the inductors (according to FIG. 13 or 14)

w: Reservoir width, distance from one well pair to the next (typically 50 to 200 m)

h: Reservoir height, thickness of the geological oil layer (typically 20 to 60 m)

d1: horizontal distance from A to C and from B to A (w/2)

d2: vertical distance from B to b: preferably 2 m to 20 m d3: vertical distance from C and B to b: preferably 5 m to 20 m.

This document has described different variants which put the subject matter of the main patent application for the EMGD method in concrete terms. The following variants are viewed as especially advantageous:

FIG. 15 with the switching variants according to FIG. 12. An inductor B is located above the production pipe b, the second inductor A is located on the border of symmetry to the adjacent part reservoir.

FIG. 16 with two circuits switching variants according to FIG. 12. Two inductors A and A' are located on the borders of symmetry to the adjacent part reservoirs. Two inductors B and B' are located above the production pipe b as well as the production pipe of the adjacent part reservoir not shown here.

FIG. 17 with switching variant according to FIG. 13 or 14. One inductor A is located above the production pipe b, the second inductor B is located on the border of symmetry to the left-hand adjacent part reservoir. The third inductor C is located on the border of symmetry to the right-hand adjacent part reservoir.

FIG. 18 with switching variant according to FIG. 13 or 14. One inductor A is located above the production pipe, the second inductor B is located at a horizontal distance d1 from the latter. The third inductor C is likewise located at a horizontal distance d1, but on the other side however.

The invention claimed is:

1. An apparatus used for the "in situ" extraction of bitumen or very heavy oil from an oil sand seam, where heat energy is applied to the seam to reduce the viscosity of the bitumen or the very heavy oil, comprising:

an electrical/electromagnetic heater including at least two conductors; and an extraction pipe to carry away the liquefied bitumen or very heavy oil and at least two conductors, wherein at a predetermined depth of the seam, the at least two conductors extend linearly and are routed in parallel in a horizontal alignment, wherein a plurality of ends of the conductors are electrically-conductively connected within or outside the seam and together form a conductor loop, wherein the conductor loop realizes a predetermined complex resistance and is connected outside the reservoir to an external alternating current generator for electrical power and wherein an inductance of the conductor loop is compensated for section-by-section, wherein a section is a portion of the conductor loop and wherein the section-by-section compensation for a conductor inductance is undertaken by a series capacitance.

2. The apparatus as claimed in claim 1, wherein an injection pipe for heating the seam with steam is present in addition to the at least two conductors supplied with electrical power.

3. The apparatus as claimed in claim 1, wherein the at least two conductors are routed at a same depth of the reservoir alongside each other, and wherein the at least two conductors are spaced apart from each other laterally at a predetermined distance.

4. The apparatus as claimed in claim 1, wherein the at least two conductors are routed at different depths of the seam above one another at a predetermined distance.

5. The apparatus as claimed in claim 1, wherein the at least two conductors include a round cross-section with an external diameter between 10 and 50 cm.

6. The apparatus as claimed in claim 5, wherein the insulator tube including the capacitor electrodes has a layer of insulation or is completely formed from an insulator.

7. An apparatus used for the "in situ" extraction of bitumen or very heavy oil from an oil sand seam, where heat energy is applied to the seam to reduce the viscosity of the bitumen or the very heavy oil, comprising:

an electrical/electromagnetic heater including at least two conductors; and an extraction pipe to carry away the liquefied bitumen or very heavy oil; and at least two conductors, wherein at a predetermined depth of the seam, the at least two conductors extend linearly and are routed in parallel in a horizontal alignment, wherein a plurality of ends of the conductors are electrically-conductively connected within or outside the seam and together form a conductor loop, wherein the conductor loop realizes a predetermined complex resistance and is connected outside the reservoir to an external alternating current generator for electrical power, and wherein an inductance of the conductor loop is compensated for section-by-section, and wherein a section is a portion of the conductor loop, wherein the at least two conductors are embodied as tubes, and wherein for the at least two conductors a plurality of capacitors are present for the outward and return conductor respectively.

8. The apparatus as claimed in claim 7, wherein to increase the capacitance or increase a dielectric strength, a plurality of capacitor electrodes are switched in parallel.

9. The apparatus as claimed in claim 7, wherein the tubular conductor includes an insulating tube in which respectively a tubular outer capacitor electrode and a tubular inner capacitor electrode are arranged, and wherein the tubular outer capacitor electrode and the tubular inner capacitor electrode are arranged section-by-section opposing each other and are coupled to one another via a dielectric.

10. The apparatus as claimed in claim 9, wherein the dielectric is formed from a ceramic or from composites based on Teflon, glass fiber, and ceramic.

11. The apparatus as claimed in claim 7, wherein a means is used for supplying an electrolyte for the tubular conductor which comprises the tubular outer capacitor electrode, the dielectric, and the tubular inner capacitor electrode.

12. The apparatus as claimed in claim 11, wherein that the electrolyte is carried within the conductor.

13. The apparatus as claimed in claim 11, wherein the electrolyte may be directed out of the insulator tube section-by-section.

14. The apparatus as claimed in claim 13, wherein the means for supplying the electrolyte includes a plurality of outlets with a plurality of valves for letting the electrolyte out of the insulator tube.

15. The apparatus as claimed in claim 14, wherein the plurality of valves are adjustable temporally and spatially section-by-section.

16. An apparatus used for the "in situ" extraction of bitumen or very heavy oil from an oil sand seam, where heat energy is applied to the seam to reduce the viscosity of the bitumen or the very heavy oil, comprising:

an electrical/electromagnetic heater including at least two conductors, and an extraction pipe to carry away the liquefied bitumen or very heavy oil; and at least two conductors, wherein at a predetermined depth of the seam, the at least two conductors extend linearly and are routed in parallel in a horizontal alignment, wherein a plurality of ends of the conductors are electrically-conductively connected within or outside the seam and together form a conductor loop, wherein the conductor loop realizes a predetermined complex resistance and is connected outside the reservoir to an external alternating current generator for electrical power, wherein an inductance of the conductor loop is compensated for section-by-section, and wherein a section is a portion of the conductor loop, and wherein the tuned conductor loop is operated by an HF power generator at a resonant frequency, wherein an output frequency of the HF power generator is tuned to the resonant frequency of the compensated conductor loop.

17. The apparatus as claimed in claim 16, wherein a power electronic resource is used as the HF power generator, which is embodied as single-phase or multi-phase.

18. The apparatus as claimed in claim 17, wherein the HF power generator is formed by a frequency-controlled converter.

* * * * *